US006568967B2

(12) United States Patent
Inaba et al.

(10) Patent No.: US 6,568,967 B2
(45) Date of Patent: May 27, 2003

(54) PROTECTIVE COVER

(75) Inventors: Shigemitsu Inaba, Shizuoka (JP); Kazuhiro Morishita, Shizuoka (JP); Tsuyoshi Hamai, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/899,081

(22) Filed: Jul. 6, 2001

(65) Prior Publication Data

US 2002/0009932 A1 Jan. 24, 2002

(30) Foreign Application Priority Data

Jul. 6, 2000 (JP) ..... 2000-205109
Jul. 6, 2000 (JP) ..... 2000-205110

(51) Int. Cl.[7] ..... H01R 13/44
(52) U.S. Cl. ..... 439/701; 439/906
(58) Field of Search ..... 439/135, 595–599, 439/701, 718, 906

(56) References Cited

U.S. PATENT DOCUMENTS

| | | | | |
|---|---|---|---|---|
| 5,295,859 A | | 3/1994 | Kawai et al. | |
| 5,338,211 A | | 8/1994 | Kodama et al. | 439/135 |
| 5,586,916 A | | 12/1996 | Shinji et al. | |
| 5,645,447 A | | 7/1997 | Sandor | |
| 5,685,736 A | | 11/1997 | Lung | |
| 5,694,681 A | * | 12/1997 | Hatagishi et al. | 439/701 |

FOREIGN PATENT DOCUMENTS

| | | | |
|---|---|---|---|
| EP | 0606739 A2 | 7/1994 | |
| EP | 0818855 A1 | 1/1998 | |
| JP | 57-25514 | 6/1982 | H01R/13/516 |
| JP | 5-27975 | 4/1993 | H01R/13/516 |
| JP | 6-36240 | 5/1994 | H01R/13/52 |
| JP | 7-22481 | 4/1995 | H01R/13/58 |
| JP | 7-122330 | 5/1995 | H01R/13/52 |
| JP | 7-288149 | 10/1995 | H01R/13/52 |
| JP | 2562613 | 10/1997 | H01R/13/52 |

* cited by examiner

*Primary Examiner*—Khiem Nguyen
(74) *Attorney, Agent, or Firm*—Sughrue Mion, PLLC

(57) ABSTRACT

In the present invention, a protective cover is provided with, a base bottom portion and a cover portion which is disposed in the base bottom portion through a hinge. The protective cover can be attached to a connector so as to be fitted with a through-lock portion of the connector and the cover portion is then closed. The base bottom portion is formed in a gutter-shape and the rear end side of the base bottom portion is partially closed by a closing portion. In the present invention, a protective cover is also provided with, a cylindrical cover main body to be fitted with a connector, and a pair of opening-and-closing members disposed on the cover main body through hinges. The protective cover further includes securing holes for securing the opening-and-closing members to securing projections disposed on the cover main body, and securing pawls and securing frames for engaging the opening-and-closing members with each other.

13 Claims, 7 Drawing Sheets

PROTECTIVE COVER

BACKGROUND OF THE INVENTION

1. Field of the Invention

The present invention relates to a protective cover for protecting a connector used for connection of an electric system disposed in an automobile and, in particular, to the structure of a protective cover for connection of a connector used in equipment used under a severe environment.

This application is based on the Japanese patent Applications No. 2000-205109 and No. 2000-205110, which are incorporated herein by references.

2. Description of the Related Art

In a vehicle such as an automobile, a connector is often used for connecting together wire harnesses or for connecting electronic equipment to a wire harness. A connector of this type is basically structured such that a connecting terminal is stored within a connector housing formed of synthetic resin and a covered wire connected to the connecting terminal is guided out from the rear end of the connector housing.

Also, in an automobile used in a severe environment, while the automobile is running, the connector can be splashed with muddy water, or, while washing, the connector can be splashed with high-pressure washing water. Further, as the automobile runs, the connector can be vibrated heavily.

With such using environment taken into consideration, there is proposed such a waterproof connector as shown in FIG. 11. This waterproof connector 50 is formed of synthetic resin in an integrated body, while it comprises a housing main body 51, a hinge portion 52, and a pair of covers 53, 54. The housing main body 51 includes a plurality of terminal storage chambers formed inside the rear portion of a substantially-square-cylindrical outer wall 55, an insertion portion 57 formed inside the front portion of the outer wall 55 for insertion of a mating connector (not shown), and a lock portion 58 formed on the upper surface of the outer wall 55 for securing the mating connector inserted.

In the rear end portion of the housing main body 51, there is formed a square-cylindrical portion 59 which is smaller in diameter than the outer wall 55. On the two side surfaces of the rear end portion of the square-cylindrical portion 59, there are integrally disposed a pair of covers 53, 54 through the hinge portion 52. Also, the central portion 52*a* of the hinge portion 52 is formed thin in thickness so that it can be flexed.

The two covers 53, 54 each have a shape obtained by dividing the square-cylindrical portion 59 along the axial direction into two; and, in case where the covers 53, 54 are rotated about the hinge portion 52 in their mutually approaching directions and their respective inner end faces 53*a*, 54*a* are engaged with each other, they provide a shape which is continuous with the rear end of the square-cylindrical portion 59.

Also, in the central portions of the respective end faces of the covers 53, 54, there are formed recessed portions 53*c*, 54*c* which, when the covers 53, 54 are closed, provide a wire penetration hole. The covers 53, 54 respectively include a securing projection 64 and a securing frame groove 65 which are engaged with each other when the inner end faces 53*a* and 54*a* are engaged with each other.

Next, description will be given below of a second example of a conventional connector with reference to FIG. 12.

A connector 70 shown in FIG. 12 comprises a connector housing 71, a rear holder 72, and a waterproof cover 73 which not only covers the outer end face of the rear portion of the rear holder 72 but also is connected to the rear holder 72 in such a manner that it can be opened and closed in the directions of arrow marks shown in FIG. 12. The rear holder 72 is made of a plate-shaped block and can be fitted into and fixed to the connector housing 71.

The waterproof cover 73 is composed of a pair of cover bodies 74, 75, while their one-side ends are connected respectively to the upper and lower surfaces of the rear holder 72 through flexible belt-shaped portions 76; and, the two cover bodies 74, 75 cooperate together in covering the outer end face of the rear holder 72 in such a manner that the rear holder 72 can be opened and closed.

The belt-shaped portion 76 of the cover body 74 is connected to the lower portion of the inner end face of the rear holder 72, while the cover body 74 can be opened upwardly in the arrow mark direction about the lower portion of the inner end face of the rear holder 72. The belt-shaped portion (not shown) of the cover body 75 is connected to the lower portion of the inner end face of the rear holder 72, while the cover body 75 can be opened downwardly in the arrow mark direction about the lower portion of the inner end face of the rear holder 72.

By the way, within the connector housing 71, there are stored connecting terminals (not shown), while covered wires 77 respectively connected to the connecting terminals are guided out from the rear end of the connector housing 71. And, in a state where the connector housing 71, rear holder 72 and waterproof cover 73 are assembled together as an integral body, the covered wires 77 are guided out from an opening 78 formed in the central portion of the rear end portion of the waterproof cover 73.

However, since the above-mentioned conventional waterproof connector 50 is a connector to be applied in a vehicle such as a truck which not only can be washed with high-pressure water but also can be used under a severe vibration condition and thus the covers 53, 54 are integrally disposed with the waterproof connector 50 through the hinge portion 52, the waterproof connector 50 is complicated in structure and the manufacturing cost thereof is high.

Further, in some of the using conditions of the connector, the waterproof function of the connector may not be necessary. That is, when the connector using condition requiring the waterproof function as well as the connector using condition not requiring the waterproof function are both taken into consideration, it is necessary to prepare a waterproof connector as well as a connector having no waterproof function. This takes an operator much time to control a connector inventory or make arrangements for production of connectors to a connector manufacturing site, which provides one of the causes of the expensive manufacturing costs of the connectors.

Also, in the case of the above-mentioned conventional connector 70, the connector housing 71 and cover 73 are separate parts and, therefore, in case where the waterproof function is not necessary, the cover 73 may be not be used, thereby being able to solve the above-mentioned problem. However, since the connector 70 employs the structure that the rear holder 72 and the two separate cover bodies 74, 75 are assembled together, there are raised other problems. For example, the number of parts is large and thus the manufacturing cost of the connector 70 is high. Also, the assembling operation of the connector 70 is troublesome, which increases the number of man-hours necessary to manufacture the connector 70.

Further, the shapes and standards of the rear holder 72 and cover bodies 74, 75 are set to the standards of the connector housing 71 and, therefore, the rear holder 72 and cover bodies 74, 75 can be applied only to an exclusive connector. Also, the standards of the connectors vary widely in correspondence to the current amounts thereof and the installation positions thereof. Thus, there are known various connector structures: for example, a structure in which securing portions for securing two connectors together are disposed on the respective housings of the two connectors; and, a structure in which a securing portion for securing a connector to part of a vehicle body is disposed on the housing of the connector. However, the cover 73 of the connector 70 can be applied only one of the above-mentioned connectors and thus lacks in versatility.

SUMMARY OF THE INVENTION

The present invention aims at eliminating the drawbacks found in the above-mentioned conventional protective covers. Accordingly, it is an object of the invention to provide a protective cover which can be assembled to an existing connector as the need arises, is excellent in the assembling efficiency, is simple in structure, and is versatile.

Also, it is an object of the invention to provide a protective cover which can be assembled to an existing connector, provides excellent assembling efficiency when it is assembled to the connector, and is excellent in vibration resistance and in waterproof function.

In attaining the above object, according to a first aspect of the invention, there is provided a protective cover for covering a connector including a through-lock portion for storing a connecting terminal to be connected to a mating connector and also for allowing a wire connected to the connecting terminal to be guided out externally therefrom, the protective cover comprising: a gutter-shaped base bottom portion to be fitted with the through-lock portion; an opening for allowing the end portion of the through-lock portion fitted with the base bottom portion to be exposed externally of the base bottom portion therefrom; a cover portion connected to the base bottom portion through a hinge for covering the base bottom portion in a state where the through-lock portion is fitted with the base bottom portion; and, a lock portion for securing the cover portion to the base bottom portion.

According to the above-structure, the protective cover comprises a gutter-shaped base bottom portion to be fitted with the through-lock portion, an opening for allowing the end portion of the through-lock portion fitted with the base bottom portion to be exposed externally of the base bottom portion therefrom, a cover portion to be connected to the base bottom portion through a hinge for covering the base bottom portion in a state where the through-lock portion is fitted with the base bottom portion, and a lock portion for securing the cover portion to the base bottom portion.

Therefore, in case where the base bottom portion of the protective cover is fitted with the through-lock portion formed in a portion of a connector housing of the above connector, a portion of the base bottom portion is exposed from an opening formed in the base bottom portion. This makes it possible to apply the present protective cover to the connector regardless of the shape of the through-lock portion; that is, the protective cover is excellent in versatility.

Also, since the base bottom portion includes the cover portion formed integral therewith through the hinge and the cover portion includes the lock portion, in case where the cover portion is placed onto the base bottom portion after the base bottom portion is fitted with the connector housing, the connector and protective cover can be integrated, thereby being able to realize the protection of the connector.

In attaining the above object, in the protective cover according to the first aspect of the invention, preferably the base bottom portion and cover portion respectively include in their respective rear end portions securing grooves for securing the end portion of a bellows-shaped tube, and the wire guided out from the through-lock portion is covered with the tube.

According to the present structure, the wire guided out from the rear end of the connector housing is covered with the bellows-shaped tube which is known as a corrugated tube, and one end of the tube is secured by the securing grooves respectively formed in the base bottom portion and cover portion. Thanks to this, not only the wire can be prevented from being bent at a sharp angle at a position where it is guided out from the rear end of the housing, but also the wire can be prevented from being cut or the connecting terminal can be positively prevented against after-removal.

Further, in the protective cover according to the first aspect of the invention, preferably the base bottom portion includes a contact portion to be contacted with a step portion formed in the through-lock portion and a closing portion having an edge portion which can be contacted with the end portion of the through-lock portion.

According to the present structure, in case where the through-lock portion is fitted with the base bottom portion, the cover portion is half fixed by the contact portion and the edge portion of the closing portion, which makes it easy to secure the cover portion to the base bottom portion, so that the present protective cover can be enhanced in the assembling efficiency as well as in the operation efficiency.

In attaining the above object, according to a second aspect of the invention, there is provided a protective cover for covering a connector storing therein a connecting terminal to be connected to a mating connector and guiding out a wire connected to the connecting terminal externally from the end portion of a housing of the connector, the protective cover comprising: a cylindrical cover main body to be removably fitted with the housing; a pair of opening-and-closing members disposed openably and closably on the cover main body through their respective hinges; a first securing member, when the opening-and-closing members are closed against each other, for securing the opening-and-closing members to one end of the cover main body; and, a second securing member, when the opening-and-closing members are closed against each other, for securing the opening-and-closing members to each other.

According to the protective cover of the second aspect of the present invention, in case where the cover main body of the protective cover is fitted with the connector housing, the pair of opening-and-closing members are closed against each other and the first and second securing members are secured together, the connector can be covered with the protective cover. Therefore, not only the present protective cover can be applied to an existing connector but also the protective cover can be assembled to the connector housing simply almost with a one-touch operation. This can facilitate the assembling operation and thus can enhance the efficiency of the assembling operation.

Also, according to the second aspect of the invention, the cover main body, preferably, may include in the front edge portion thereof, a stopper which can be contacted with the front end of the connector housing to thereby position the connector housing.

Further, the pair of opening-and-closing members, preferably, may be structured such that, when they are closed, their respective front edge portions can be contacted with the outer periphery of the connector housing.

According to such the structure, the front end portion of the connector housing is contacted with the stopper, and the front edge portions of the opening-and-closing members are contacted with the step portions and rear end portion of the connector housing. Therefore, the connector and protective cover can be integrated with no play, thereby being able to protect the connector positively.

Moreover, preferably, the opening-and-closing members may respectively include, in the inner surfaces of the rear portions thereof, securing grooves for securing the end portion of a bellows-shaped tube, and the wire guided out externally from the end portion of the housing may be covered with the tube.

According to the present protective cover, since the bellows-shaped tube is placed around the wire guided out externally from the rear end portion of the connector housing, there is eliminated the possibility that the wire can be bent at a sharp angle at the position where it is guided out externally from the rear end portion of the connector housing, thereby being able not only to positively prevent the wire from being cut but also to positively prevent the connecting terminal against after-removal.

DETAILED DESCRIPTION OF THE PREFERRED EMBODIMENTS

First Embodiment

Figure 1:
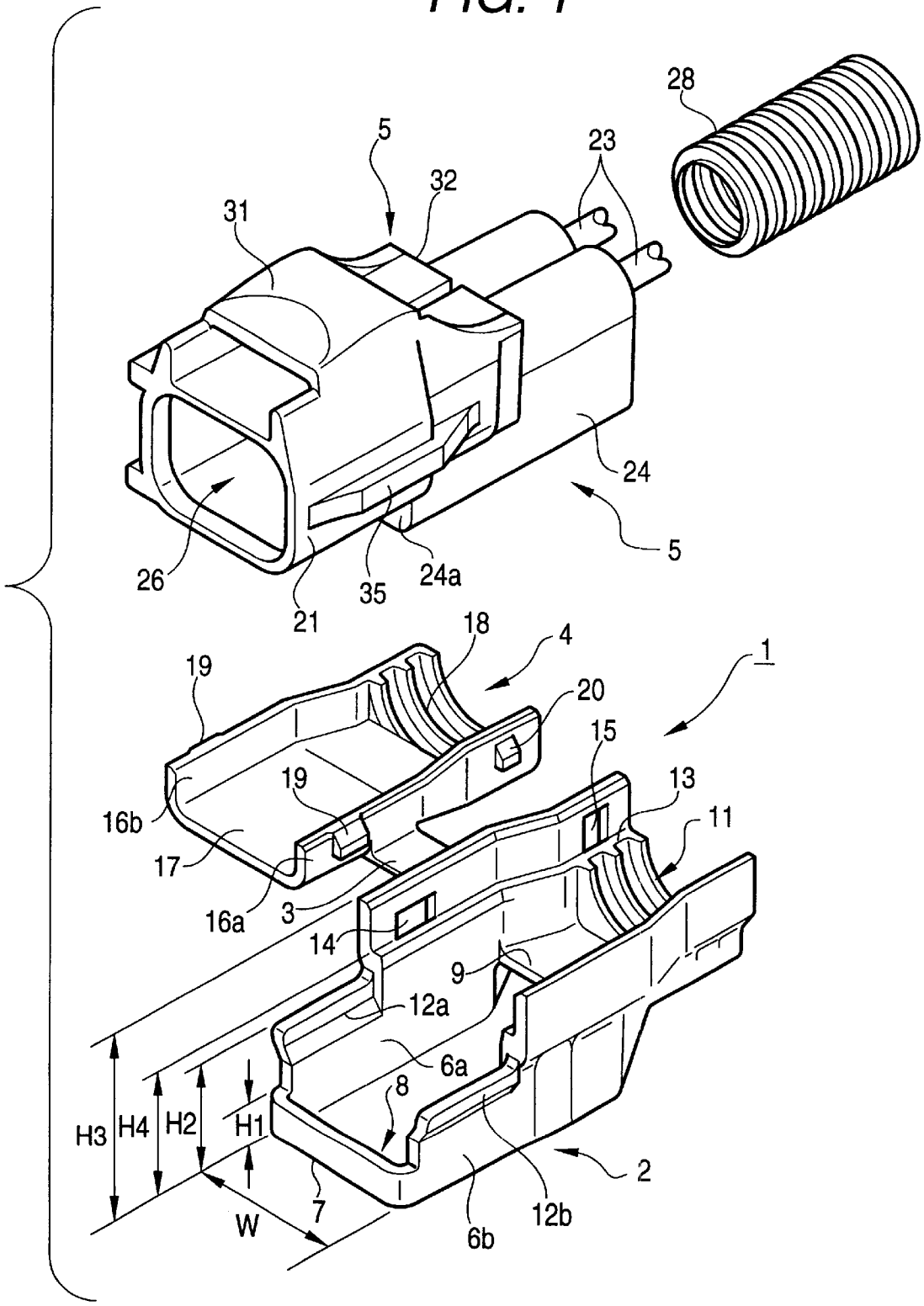
FIG. 1 is an exploded perspective view of the first embodiment of a protective cover according to the invention.
Figure 2:
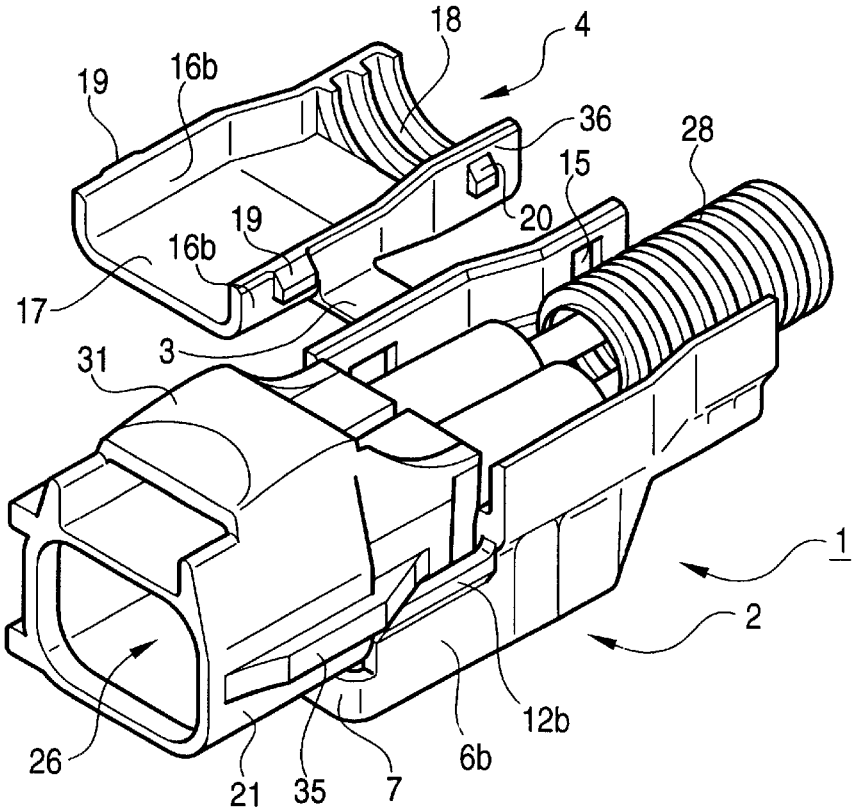
FIG. 2 is a perspective view of the protective cover shown in FIG. 1, showing an intermediate state of the process for assembling state to a connector.
Figure 3:
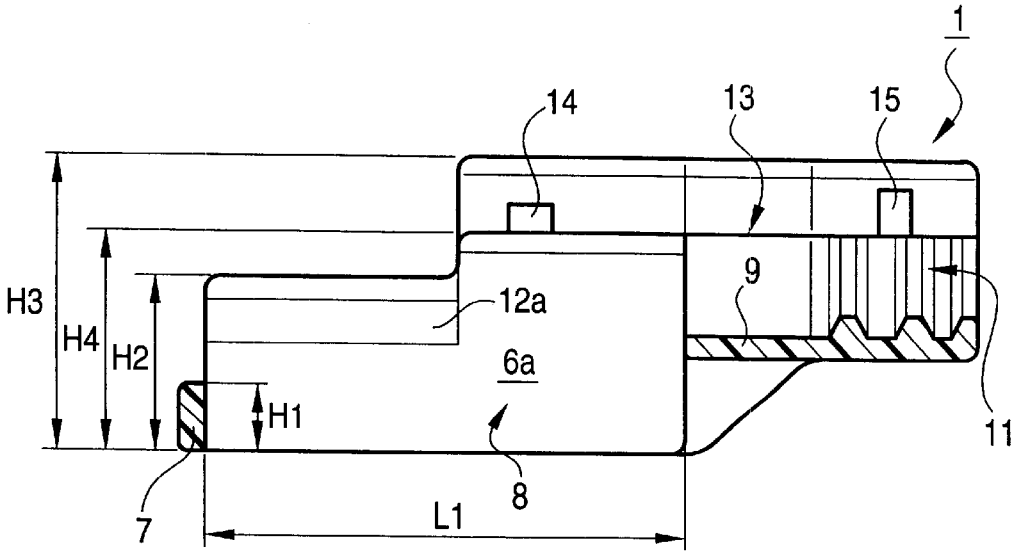
FIG. 3 is a longitudinal section view of the structure of the protective cover shown in FIG. 1.
Figure 4:
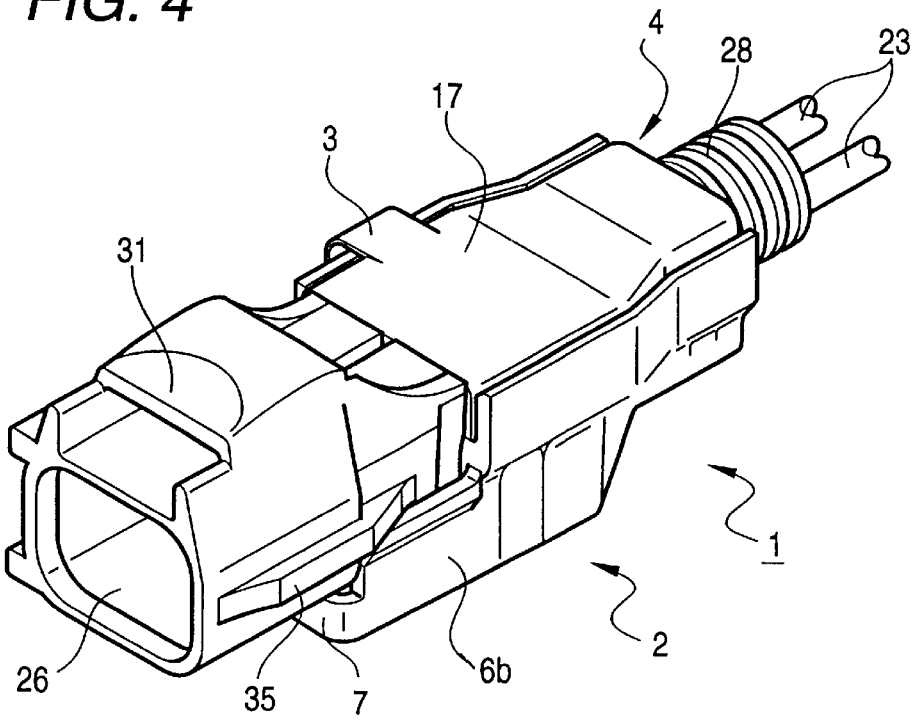
FIG. 4 is a perspective view of the protective cover shown in FIG. 1, showing a state where it is completely assembled to a connector.
Figure 5:
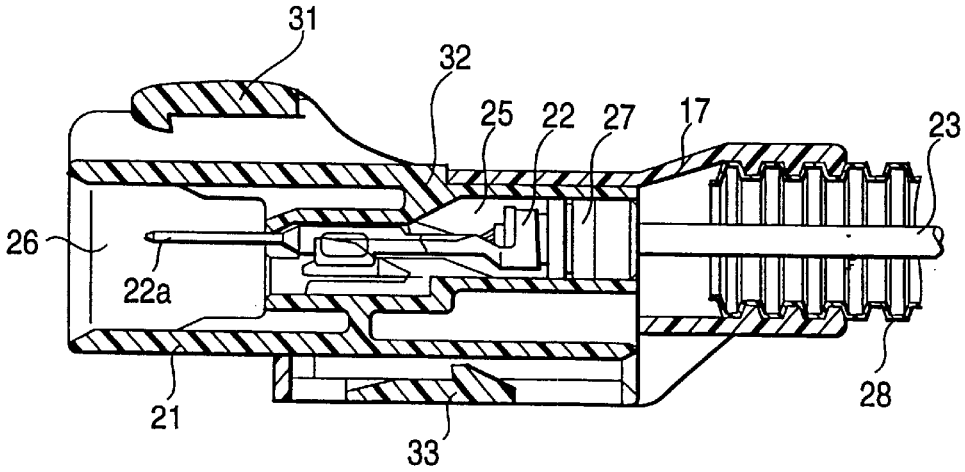
FIG. 5 is a longitudinal section view of the protective cover shown in FIG. 4.

Now, description will be given below in detail of an embodiment of a protective cover according to the invention with reference to FIGS. 1 to 5. FIG. 1 is an exploded perspective view of the structure of a protective cover according to the present embodiment as well as the structure of a connector; FIG. 2 is a perspective view of the protective cover, showing the process for assembling the protective cover to the connector shown in FIG. 1; FIG. 3 is a longitudinal section view of the structure of the protective cover shown in FIG. 1; FIG. 4 is a perspective view of the protective cover shown in FIG. 1, showing a state of completion of its assembly; and, FIG. 5 is a longitudinal section view of the protective cover shown in FIG. 4.

By the way, in the description of the present embodiment, the structure of the protective cover will be firstly described and, next, the process for assembling the protective cover into the connector will be described.

As shown in FIG. 1, a protective cover 1 according to the present embodiment is formed of synthetic resin as an integrated body which, as shown on the lower side in FIG. 1, is composed of a gutter-shaped base bottom portion 2 and a cover portion 4 disposed on the base bottom portion 2 through a hinge 3. The protective cover 1 can be fitted a through-lock portion 24 formed in the rear end portion of a connector 5 from below the connector 5 and then, in case where the cover portion 4 is closed, the protective cover 1 can be assembled to the connector 5 as a united body.

Firstly, description will be given below of the base bottom portion 2.

The base bottom portion 2 includes a pair of mutually opposed side wall portions 6*a*, 6*b* on the two sides of the front end portions thereof, while the respective front end lower portions of the two side wall portions 6*a*, 6*b* are connected to each other through a plate-shaped contact portion 7. Also, in the lower portion of an area on the base bottom portion 2 that is surrounded by the pair of side wall portions 6*a*, 6*b* and contact portion 7, there is formed an opening 8 consisting of a fitting space which communicates in the vertical direction of the protective cover 1 (see FIG. 3).

The rear end side of the bottom base portion 2 is closed in part by a closing portion 9; and, adjacently to the closing portion 9, there is formed a semicircular-shaped cylindrical portion and, in the inner surface of the cylindrical portion, there is formed a securing groove 11.

As shown in FIG. 3, the bottom base portion 2 is formed so as to have a two-step height which consists of the height H1 of the contact portion 7 and the heights H2 and H3 of the two side wall portions 6*a*, 6*b*. The heights H1 through H3 of the contact portion 7 and side wall portions 6*a*, 6*b*, the transverse width W of the inner surfaces of the side wall portions 6*a*, 6*b*, and the length L1 from the inner surface of the contact portion 7 to the leading end of the closing portion 9 are respectively set to the shape of the outer surface of a housing 21 forming the connector 5 which will be discussed later.

Also, on the inner surfaces of the upper edges of the height H2 portions of the two side wall portions 6*a*, 6*b*, there are disposed curved portions 12*a*, 12*b* projected in part outwardly, which not only can reinforce these portions but also allows the side wall portions 6*a*, 6*b* to be elastically engaged with the housing 21 which will be discussed later. Also, on the inner surfaces of the height H3 portions that exist at the positions of height H4 portions of the two side wall portions 6*a*, 6*b*, there are disposed step portions 13, respectively. These step portions 13, when the base bottom portion 2 is covered by the cover portion 4, provide a receiving portion for receiving the cover portion 4 and thus the cover portion 4 can be restricted in position by the step portions 13.

Further, in the inner surfaces of the height H3 portions of the two side wall portions 6*a*, 6*b*, there are formed two securing recessed portions 14, 15 which can secure the cover portion 4 in such a manner that it is prevented from slipping out of the base bottom portion 2. By the way, in the opposing inner surface of the other side wall portion as well, similarly, there are formed two securing recessed portions 14, 15 (in FIG. 1, there are shown only one securing recessed portions of the two). Also, on the cover portion 4, there are disposed securing projections 19, 20 (to be described later) which can be secured respectively into their associated securing recessed portions 14, 15.

Next, description will be given below of the structure of the cover portion 4.

The cover portion 4 is disposed on one side surface of the base bottom portion 2 through the hinge 3. And, the cover portion 4 includes a pair of side wall portions 16*a*, 16*b*, a top plate 17, and a securing groove 18 formed so as to adjoin the top plate 17. The securing groove 18 is structured such that the ridges and valleys thereof are identical with those of the securing groove 11 formed in the base bottom portion 2. Therefore, in case where the cover portion 4 is placed on the base bottom portion 2, there are formed annular grooves which are substantially identical with bellows-shaped grooves formed in a tube 28 which will be discussed later.

Also, on the outer surfaces of the pair of side wall portions 16*a*, 16*b*, there are disposed securing projections 19, 20 which can be secured to the securing recessed portions 14, 15. Also, the hinge 3 is integrally connected with the outer surface of the top plate 17.

Next, description will be given below of the structure of the connector 5.

Two connecting terminals 22 are stored within the housing 21 of the connector 5 (See FIG. 5) and two wires 23 respectively connected to the two connecting terminals 22 are guided out from the through-lock portion 24 disposed on the rear end side of the housing 21.

As shown in FIG. 5, in the interior portion of the housing 21, there are formed two terminal storage chambers 25 in such a manner that they are arranged side by side through a partition, while the two connecting terminals 22 are respectively stored in the interior portions of the terminal storage chambers 25 in such a manner that they are prevented from slipping out thereof. That is, a rod-shaped connecting portion 22*a* formed in the leading end portion of each connecting terminal 22 is projected into a fitting opening 26 into which a mating connector can be fitted, while the wire 23 connected to the rear end of the connecting terminal 22 by caulking is guided externally of the connector through the interior portion of the through-lock portion 24 (see FIG. 1). Also, a waterproof plug 27 is fitted with the outer surface of the wire 23 existing in the housing 21.

Also, on the upper portion of the housing 21, there is disposed a securing portion 31 which can be secured to a mating connector; on the rear end side of the securing portion 31, there is formed a step portion 32; and, in the rear of the step portion 32, there is formed the through-lock portion 24.

Further, a portion of the through-lock 24 projects into the lower portion of the housing 21 to thereby form a securing portion 33 in the interior portion of the housing 21 (see FIG. 5). This securing portion 33 is used to fix the connector 5 for example, to a given mounting portion of a vehicle.

By the way, the conventional protective cover cannot be applied to a connector in which the securing portion 33 is formed, whereas the protective cover 1 according to the present embodiment can be applied whether the securing portion 31 is formed or not, so that the present protective cover 1 is excellent in versatility.

Next, description will be given below of the process for assembling the protective cover 1 to the connector 5.

Firstly, as shown in FIG. 1, in the assembly, with the cover portion 4 of the protective cover 1 opened, the protective cover 1 is fitted into the through-lock portion 24 of the connector 5 from below the connector 5. In this fitting operation, the connector 5 is fitted into the protective cover 1 in such a manner that the projecting portion of the lower portion of the through-lock portion 24, in which the securing portion 33 is formed, is inserted into the opening 8 formed between the contact portion 7 and the leading end portion of the closing portion 9.

Referring in more detail to this fitted state, the protective cover 1 is fitted into the clearance L1 portion in such a manner that not only the step portion 24*a* of the through-lock portion 24 is contacted with the inner surface of the contact portion 7 but also the rear end of the through-lock portion 24 is contacted with the leading end portion of the closing portion 9. Due to this, the connector 5 can be fitted in such a manner that it is prevented against play in the connector fitting direction. Also, since the curved portions 12*a*, 12*b* are respectively formed in the pair of side wall portions 6*a*, 6*b*, the connector 5 can be fitted elastically.

And, because there are formed two flanges 35 respectively on the two sides of the housing 21, as shown in FIG. 4, the upper edges of the portions of the side wall portions 6*a*, 6*b*, which are set at the height H2 position, are respectively contacted with the lower portions of the flanges 35, which not only prevents any further insertion of the protective cover 1 but also prevents the protective cover 1 from being obliquely fitted with the connector 5.

In this manner, after the protective cover 1 is engaged with the through-lock portion 24 formed on the rear end side of the housing 21 of the connector 5, as shown in FIG. 2, the tube 28 is placed around the two wires 23 and is secured to the wires 23 in such a manner that a bellows-shaped annular groove formed in the surface of the tube 28 is engaged with the securing groove 11 (see FIG. 1).

Next, the cover portion 4 is rotated about the hinge 3, so that a pair of side wall portions 16*a*, 16*b* are respectively fitted into the side wall portions 6*a*, 6*b* to thereby push the cover 4 into the base bottom portion 2. As a result, the securing projections 19, 20 are respectively secured to the securing recessed portions 14, 15 and thus, as shown in FIG. 4, the cover portion 4 is engaged with the base bottom portion 2. Therefore, by covering the upper portion of the base bottom portion 2 with the cover portion 4, as shown in FIGS. 4 and 5, the entire through-lock portion 24 is covered with the protective cover 1 and the tube 28 covering the end portions of the wires 23 is guided out from the rear end side of the protective cover 1.

As described above, in a state where the protective cover 1 is assembled to the connector 5, step portions 36 formed on the outer surfaces of the upper edges of the side wall portions 16*a*, 16*b* forming the cover portion 4 are respectively contacted with the step portions formed on the inner surfaces of the side wall portions 6*a*, 6*b*, while the inner surfaces of the side wall portions 16*a*, 16*b* upper edges lower from the stepped portions 13 along the inner surfaces of the side wall portions 16*a*, 16*b*. That is, at the positions where the step portions 13, 36 are contacted with each other, the outer surfaces thereof are contacted in a crank manner and, therefore, there can be obtained a wide contact surface.

Thanks to this, at the contact positions of the base end portion 2 and cover portion 4, there can be obtained a high watertight condition; for example, entry of muddy water can be prevented during the running operation of the vehicle, or, even in case where high-pressure water is applied due to car washing, invasion of the washing water can be prevented.

Also, since the wires 23 are covered with the tube 28 and the end portion of the tube 28 is secured to the end portion of the protective cover 1, there is eliminated a possibility that the end portions of the wires 23 can be curved at a sharp angle, thereby being able to prevent the connecting terminal 22 in the housing 21 against after-removal.

Also, even after the protective cover 1 is fitted with the connector 5, the securing portion 33 is exposed from the opening 8 formed in the base bottom portion 2, which makes it possible to mount the connector 5 at a given position of the vehicle; that is, the versatility of the protective cover 1 can be enhanced.

Further, when the protective cover 1 is fitted with the connector 5, the front end portion of a top plate 17 forming the cover portion 4 is contacted with the step portions 32 and, therefore, the contact portion 7 of the protective cover 1, the front end portion of the closing portion 9 and the front end portion of the top plate 17 cooperate together to position the protective cover 1 positively with respect to the connector 5, which can prevent the protective cover 1 against play.

As described above, in the protective cover 1 according to the present embodiment, by a simple operation that the base bottom portion 2 is fitted with the through-lock portion 24 formed in the connector 5 to close the cover portion 4 disposed in the base bottom portion 2 through the hinge 3, the protective cover 1 can be assembled to the connector 5.

Also, since the opening 8 for exposing the end portion of the through-lock portion 24 is formed in the base bottom portion 2, even in case where, as in the present embodiment, the securing portion 33 is formed in the portion where the through-lock portion 24 is exposed, the present protective cover 1 can be applied to the connector 5. That is, the versatility of the protective cover 1 can be enhanced.

Further, because the securing grooves 11, 18 are respectively formed in the base bottom portion 2 and cover portion 4, by closing the cover portion 4 with respect to the base bottom portion 2, the tube 28 covering the end portions of the wires 23 can be secured. Therefore, not only the wires 23 can be prevented from being bent at a sharp angle but also direct invasion of muddy water can be prevented.

Moreover, since the base bottom portion 2 and cover portion 4 respectively include the lock portions which can be engaged with each other, for example, even in case where the hinge 3 is cut during the running operation of the vehicle, there is no fear that the cover portion 4 can slip off the base bottom portion 2. This can prevent the protective cover 1 from slipping off the connector 5 and can prevent the tube 28 against removal, so that there can be obtained a highly reliable protective cover.

As has been described heretofore, the protective cover according to the invention comprises the gutter-shaped base bottom portion with which the through-lock portion can be fitted, the opening for exposing the end portion of the through-lock portion fitted with the base bottom portion externally of the base bottom portion, the cover portion for covering the base bottom portion in a state that the through-lock portion is fitted with the base bottom portion, and the lock portion for securing the cover portion to the base bottom portion.

Therefore, in case where the base bottom portion of the protective cover is fitted with the through-lock portion formed in a portion of the connector housing, a portion of the protective cover is exposed from the opening formed in the base bottom portion. This makes it possible to use the protective cover regardless of the shape of the through-lock portion and thus the protective cover is excellent in versatility.

Also, since the base bottom portion includes the cover portion formed integral therewith through the hinge portion and the cover portion includes the lock portion, after the base end portion is fitted with the connector housing, simply in case where the cover portion is placed on the base bottom portion and the base bottom portion is pushed into the connector housing, the connector and protective cover can be integrated. This not only can enhance the efficiency of the operation to assemble the protective cover to the connector but also can positively prevent the protective cover against play.

Further, in the present protective cover, the base bottom portion and cover portion respectively include in the rear end portions thereof the securing grooves for securing the end portion of the bellows-shaped tube, and the wires guided out from the through-lock portion are covered with the tube. This can not only prevent the wires from being bent at a sharp angle at the positions where they are guided out externally from the rear end of the connector housing but also positively prevent the wires from being cut as well as can positively prevent the connecting terminal against after-removal.

Moreover, in the protective cover, the base bottom portion includes the contact portion to be contacted with the step portions forming the through-lock portion and the closing portion having the edge portion to be contacted with the end portion of the through-lock portion. Thanks to this, in case where the through-lock portion is fitted with the base bottom portion, the protective cover is half fixed to the connector due to the contact portion and closing portion, which can facilitate the securing operation of the cover portion. Therefore, the assembling efficiency of the protective cover as well as the operating efficiency thereof can be enhanced further.

Second Embodiment

Figure 6:
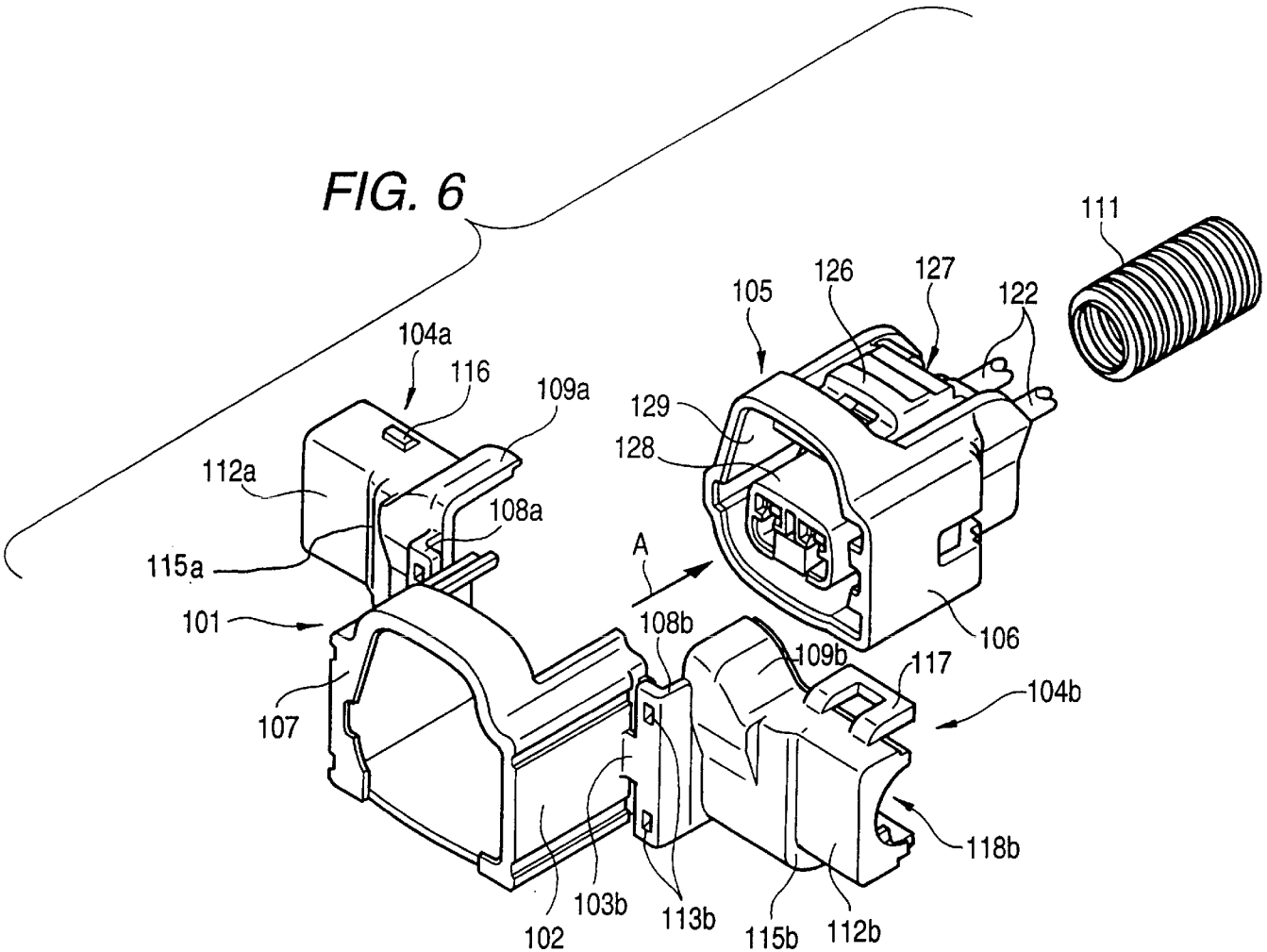
FIG. 6 is an exploded perspective view of the second embodiment of a protective cover according to the invention.
Figure 7:
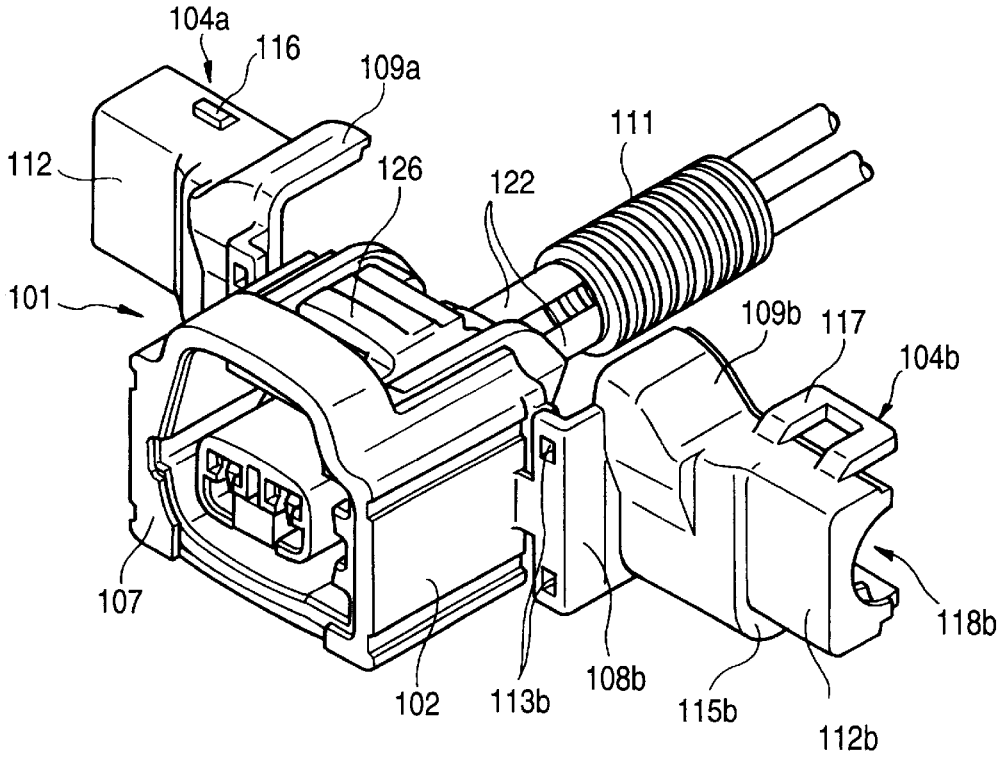
FIG. 7 is a perspective view of the protective cover shown in FIG. 6, showing an intermediate state of the process for assembling it to a connector.
Figure 8:
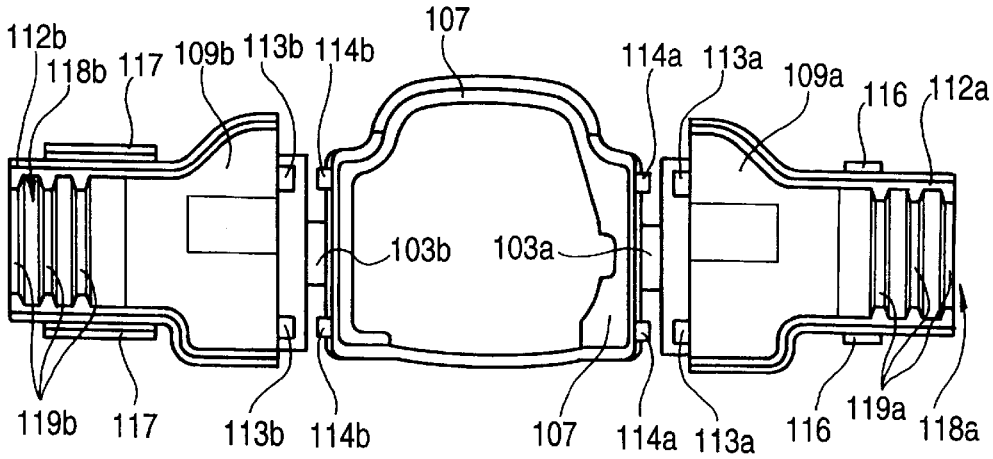
FIG. 8 is a side view of the structure of the protective cover shown in FIG. 6.
Figure 9:
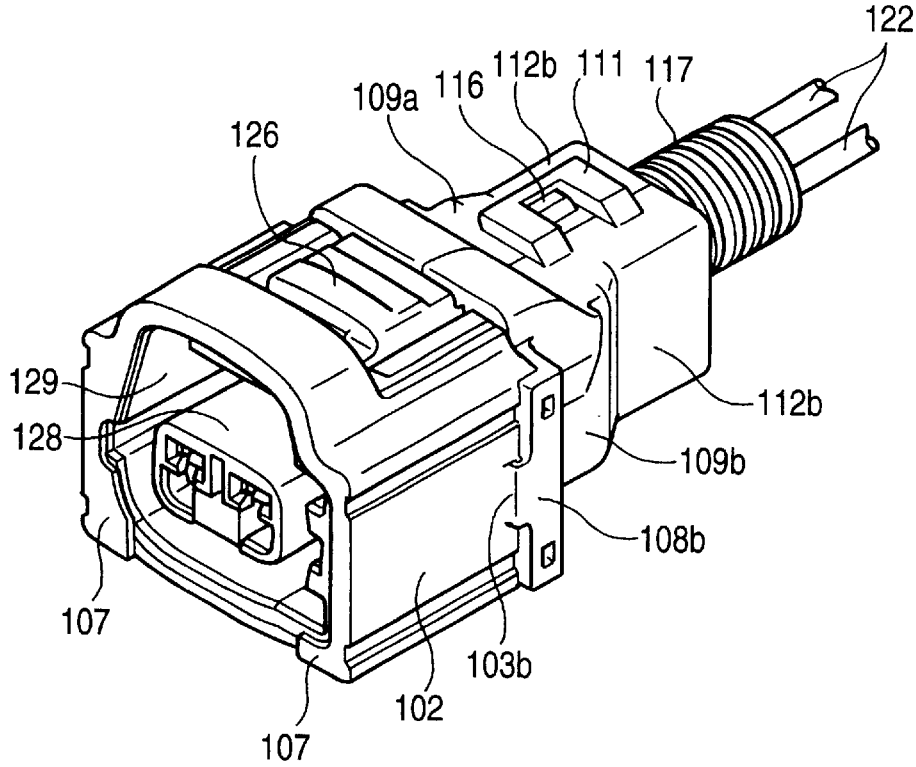
FIG. 9 is a perspective view of the protective cover shown in FIG. 6, showing a completed state of the process for assembling it to the connector.
Figure 10:
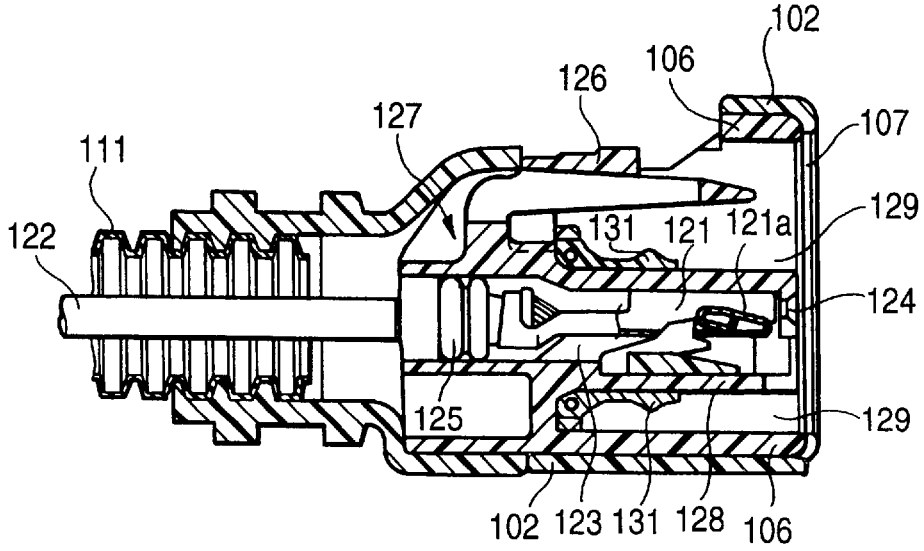
FIG. 10 is a section view of the protective cover and connector shown in FIG. 9.
Figure 11:
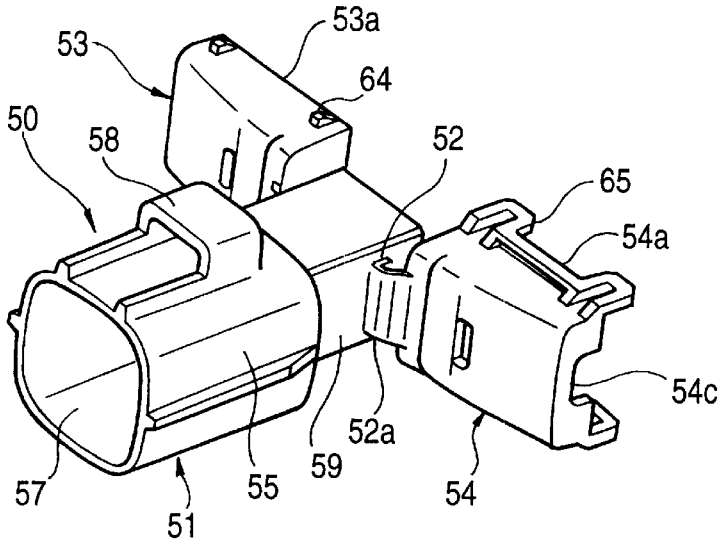
FIG. 11 is a perspective view of a first example of a conventional connector; and, FIG. 12 is a perspective view of a second example of a conventional connector.
Figure 12:
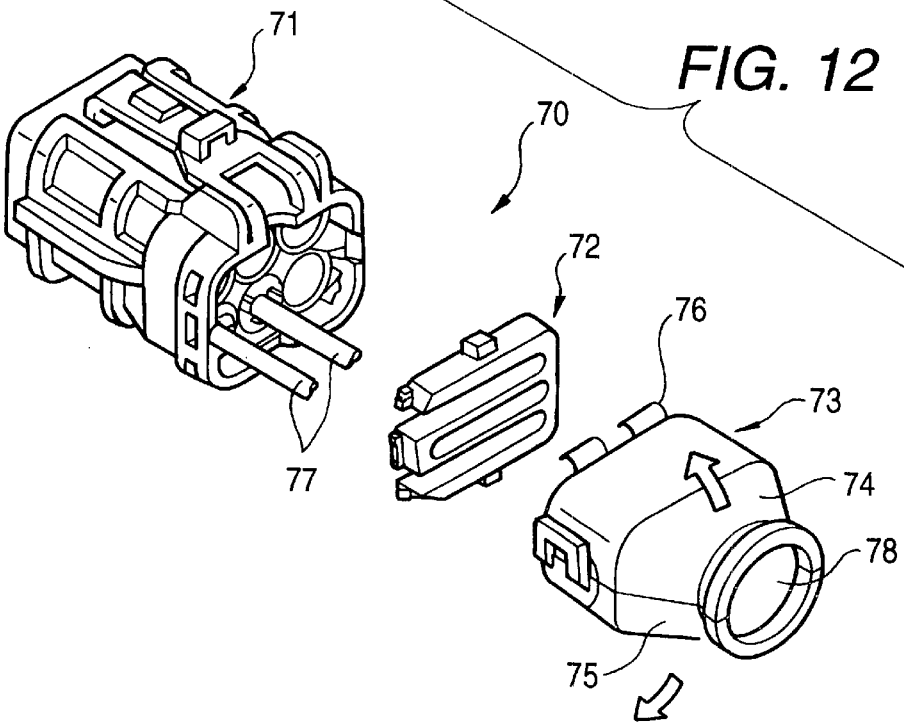

Now, description will be given below of the second embodiment of a protective cover according to the invention with reference to FIGS. 6 to 10. FIG. 6 is an exploded perspective view of an embodiment of a protective cover according to the invention; FIG. 7 is a perspective view of the protective cover shown in FIG. 6, showing an intermediate state of the process for assembling the protective cover to a connector; FIG. 8 is a side view of the protective cover shown in FIG. 6, when it is viewed from the rear end side thereof; FIG. 9 is a perspective view of the protective cover shown in FIG. 6, showing a state thereof in which it is completely assembled to the connector; and, FIG. 10 is a section view of the protective cover, showing its assembled state shown in FIG. 9.

By the way, in the following description of the present embodiment, the structure of the protective cover will be firstly described and, after then, the process for assembling the protective cover to the connector will be discussed.

As shown in FIG. 6, a protective cover 101 according to the present embodiment is an integrated body which consists of a cylindrical cover main body 102 and a pair of opening-and-closing members 104*a*, 104*b* disposed on the cover main body 102 respectively through their associated hinges 103*a*, 103*b*. The protective cover 101 is fitted with a connector 105 with which a mating connector can be connected, as shown by an arrow mark A in FIG. 6, from the front end side of the connector 105; and, after then, in case where the pair of opening-and-closing members 104*a*, 104*b* are closed against each other, the protective cover 101 can be integrally assembled to the connector 105.

The interior shape of the cover main body 102 of the protective cover 101 is set to the exterior shape of a housing 106 forming the connector 105 and, in the front end portion of the cover main body 102, there is disposed a flange-shaped stopper 107 in such a manner that it projects inwardly of the cover main body 102. The projecting shape of the stopper 107 is set to the shape of the front end portion of the housing 106.

Also, the pair of opening-and-closing members 104*a*, 104*b* are arranged symmetrical and can be opened and closed respectively by the hinges 103*a*, 103*b*. The opening-and-closing members 104*a*, 104*b* are each formed in a shape which can be obtained by dividing a cylindrical body in the longitudinal direction thereof; and, they respectively comprise substantially-L-shaped connecting portions 108*a*, 108*b* formed so as to be continuous with the hinges 103*a*, 103*b*, housing closing portions 109*a*, 109*b* with their respective upper end portions formed as inclined surfaces, and securing portions 112*a*, 112*b* for securing a bellows-shaped tube (corrugated tube) 111 which will be discussed later.

Further, referring in more detail to the opening-and-closing members 104*a*, 104*b*, the curved shapes of the connecting portions 108*a*, 108*b* are set to the outer shape of the housing 106 of the connector 105 which will be discussed later.

Also, as shown in FIG. 8, on the side surfaces of the connecting portions 108*a*, 108*b*, there are formed securing holes 113*a*, 113*b* by two each which form one of first securing members for securing the opening-and-closing members 104*a*, 104*b* to the housing 106. These securing holes 113*a*, 113*b* are to be secured to securing projections 114*a*, 114*b* which are disposed on the outer surfaces of the rear end portions of the cover main body 102 and form the other of the first securing members.

And, the securing portions 112*a*, 112*b* are respectively formed by drawing the rear portions of the housing closing portions 109*a*, 109*b*; and, between the housing closing portions 109*a*, 109*b* and securing portions 112*a*, 112*b*, there are formed step portions 115*a*, 115*b* respectively.

Also, on the upper portion of the securing portion 112*a*, there are disposed two securing pawls 116 which form one of second securing members; and, on the upper portion of the securing portion 112*b*, there are disposed two securing frames 117 which form the other of the second securing members. These securing pawls 116 and securing frames 117 are used in such a manner that, when the pair of opening-and-closing members 104*a*, 104*b* are closed against each other, they secure the opening-and-closing members 104*a*, 104*b* to each other.

Further, in the respective rear end portions of the securing portions 112*a*, 112*b*, there are formed semicircular-shaped recessed portions 118*a*, 118*b* respectively. When the pair of opening-and-closing members 104*a*, 104*b* are closed against each other, the recessed portions 118*a*, 118*b* are held against each other to thereby form a circular opening.

And, as shown in FIG. 8, in the inner surfaces of the securing portions 112*a*, 112*b*, there are formed securing grooves 119*a*, 119*b* respectively. When the pair of opening-and-closing members 104*a*, 104*b* are closed against each other, the securing grooves 119*a*, 119*b* turn into continuous circular-ring-shaped grooves and thus the tube 111 can be secured by the securing grooves 119*a*, 119*b*.

Next, description will be given below of the structure of the connector 105. As shown in FIG. 10, two connecting terminals 121 are stored within the housing 106, while two wires 122 respectively connected to their associated connecting terminals 121 are guided out externally from the rear end side of the housing 106. That is, in the interior portion of the housing 106, there are formed two terminal storage chambers 123 side by side with a partition between them; and, the connecting terminals 121 are respectively stored in their associated terminal storage chambers 123 in such a manner that they are prevented against removal therefrom. Also, a plate-spring-shaped connecting portion 121*a*, which is formed in the leading end portion of each connecting terminal 121, is positioned at a position facing an insertion hole 124 into which a male-type terminal of a mating connector can be inserted; and, the wire 122, which is caulked backwardly of the connecting terminal 121 and is fitted with a waterproof stopper 125, can be guided out externally from the rear end side of the housing 106. By the way, the tube 111 to be placed around the wires 122 will be discussed later.

And, on the upper portion of the outside of the housing 106, as shown in FIG. 6, there is disposed a securing member 126 which can be secured to the mating connector and, in the rear of the securing member 126, there is formed a step portion 127.

Also, in the portion of the housing 106 that exists in the interior of the housing 106 and on the outside of a cylindrical partition 128, there is formed a fitting opening 129; and, in the deep portion of the fitting opening 129, there is inserted a waterproof packing 131.

Next, description will be given below of the procedure for assembling the protective cover 101 to the connector 105.

That is, in the assembling procedure, firstly, as shown in FIG. 6, the wires 122 are covered with the tube 111 and are positioned in the vicinity of the rear end portion of the connector 105. And, in a state where the pair of opening-and-closing member 104*a*, 104*b* disposed on the protective cover 101 are opened respectively, the cover main body 102 is placed onto the connector 105 from ahead of the connector 105 in such a manner as shown by an arrow mark A in FIG. 6 and the connector 105 is fitted into the cover main body 102 in such a manner as shown in FIG. 7. Then, the connector 105 is pushed in until the front end portion thereof is contacted with the inner surface of the stopper 107.

Next, the opening-and-closing members 104*a*, 104*b* held opened are closed against each other. At the then time, the tube 111 is put into between the securing grooves 119*a*, 119*b* and, at the same time, the securing pawls 116 are respectively secured to their associated securing frames 117, which, as shown in FIGS. 9 and 10, completes the assembly of the protective cover 101 to the connector 105.

At the same time, the securing projections disposed on the outer surface of the rear end portion of the cover main body are engaged with the securing holes formed on the side surfaces of the connecting portions of the opening-and-closing members.

In this state, except for the fitting opening 129 and the securing member 126 disposed on the upper portion of the housing 106, almost all portions of the connector 105 are covered with the protective cover 101 and the wires 122 are guided out only by a given length from the rear end portion of the housing 106 in such a state that they are covered with the tube 111.

As described above, in a state where the connector 105 is covered with the protective cover 101, removal of the connector 105 in the front end direction thereof is prevented by the stopper 107, while removal of the connector 105 in the rear end direction thereof is prevented by contact between the step portions 115*a*, 115*b* of the protective cover 101 and the step portion 127 of the rear end portion of the connector 105. And, the protective cover 101 is integrated with the connector 105 through the first and second securing members and thus the connector 105 can be positively protected against peripheral members as well as against flying objects such as stone.

Also, since the wires 122 are covered with the tube 111 and the end portion of the tube 111 is secured to the end portion of the protective cover 101, there is eliminated the possibility that the wires 122 can be bent at a sharp angle, which makes it surely possible to prevent the wires 122 from being cut as well as prevent the connecting terminals 121 against after-removal.

Accordingly, the protective cover 101 according to the present embodiment can be assembled to the connector 105 by a simple operation: that is, the protective cover 101 maybe fitted with the connector 105 from the front end side of the connector 105 and the pair of opening-and-closing members 104*a*, 104*b* may be then closed against to each other.

Also, even in case where the hinges 103*a*, 103*b* are cut while the protective cover 101 is assembled to the connector 105, the first securing members can prevent the connecting portions 108*a*, 108*b*, housing closing portions 109*a*, 109*b* and securing portions 112*a*, 112*b* from being separated from the cover main body 102.

As a result, the protective cover 101 can be prevented from slipping off the connector 105 as well as the tube 111 can be prevented against removal, which can prevent the connector 105 from being broken due to vibrations as well as can prevent high-pressure washing water from invading into the interior portion of the connector 105. This makes it possible to supply the connector 105 with a protective cover which is excellent in safety and durability.

As has been described heretofore, a protective cover according to the invention comprises a cylindrical cover main body which can be removably fitted with the housing of a connector to be covered, a pair of opening-and-closing members disposed on the end portions of the cover main body respectively through their associated hinges in such a manner that they can be freely opened and closed, first securing members which, when the opening-and-closing members are closed against each other, can secure the opening-and-closing members to one end of the cover main body, and second securing members which, when the opening-and-closing members are closed against each other, can secure the opening-and-closing members to each other.

Thanks to this structure, in case where the cover main body is fitted with the connector, the pair of opening-and-closing members are closed against each other and the first and second securing members are secured together, the connector can be covered with the protective cover positively and easily almost with a one-touch operation. Therefore, the present protective cover not only can be applied to a specially-designed connector as well as to other types of connectors, but also can facilitate the assembling operation of the protective cover to the connector, thereby being able to enhance the efficiency of the assembling operation.

Also, according to the cover main body, in the front edge portion of the cover main body, there is disposed a stopper which can be contacted with the front end of the connector housing to thereby position the same.

Further, the pair of opening-and-closing members are structured such that, when they are closed against each other, their respective front edge portions can be contacted with the outer periphery of the connector housing.

That is, the front end portion of the connector housing is contacted with the stopper and the front edge portions of the opening-and-closing members are contacted with the step portion and rear end portion of the housing, thereby being able to protect the connector positively. Therefore, the connector and protective cover can be integrated together with no play and they can be prevented against breakage caused by vibrations, which makes it possible to supply a connector with a protective cover which is excellent in safety and durability.

Further, the opening-and-closing members respectively include, in the inner surfaces of the rear portions thereof, securing grooves for securing the end portion of a bellows-shaped tube, while wires guided out externally from the end portion of the housing are covered with the tube.

Therefore, there is eliminated the possibility that the wires guided out can be bent at a sharp angle at the position of the end portion of the housing, which makes it possible to positively prevent the wires from being cut as well as prevent the connecting terminals against after-removal. Thus, there can be supplied a protective cover which is more excellent in safety and durability.

What is claimed is:

1. A protective cover for covering a connector provided with a through-lock portion accommodating a connecting terminal and allowing a wire to be connected with the connecting terminal and to be guided to outside, said protective cover comprising:

a gutter-shaped base bottom portion fitting with said through-lock portion;

an opening formed on said base bottom portion for allowing an end portion of said through-lock portion to be externally exposed from said base bottom portion;

a cover portion connected to said base bottom portion through a hinge; and a lock portion for engaging said cover portion with said base bottom portion;

wherein said cover portion covers said base bottom portion in a state where said through-lock portion is fitted with said base bottom portion.

2. A protective cover according to claim 1, wherein securing grooves are provided at rear ends of said base bottom portion and said cover portion, and said wire guided from said through-lock portion is covered with a bellows-shaped tube engaged with said through-lock portion at said securing grooves.

3. A protective cover according to claim 1, wherein said base bottom portion includes a contact portion to be contacted with a step portion formed in said through-lock portion and a closing portion having an edge portion to be contacted with the end portion of said through-lock portion.

4. A protective cover for covering a connector provided with a housing accommodating a connecting terminal and allowing a wire to be connected with the connecting terminal and to be guided to outside, said protective cover comprising:

a cylindrical cover main body to be fitted with said housing, said cover main body including a recess which receives said housing in a fitting direction so that said housing is exposed;

a pair of opening-and-closing members rotatably disposed on said cover main body through hinges so as to be operative to form an open and closed state;

a first securing member for engaging at least one of said opening-and-closing members and one end of said cover main body; and, a second securing member for engaging said opening-and-closing members with each other;

wherein both of said first and second securing members are engaged when said opening-and-closing members are closed against each other, and wherein said opening and closing members respectively have a tapered section which decreases in diameter so as to correspond in shape to a portion of the connector.

5. A protective cover according to claim 4, wherein said cover main body includes in the front edge portion thereof a stopper brought into contact with the front end of said housing to thereby position said housing.

6. A protective cover according to claim 4, wherein said pair of opening-and-closing members are configured in such a manner that their respective front edge portions can be contacted with the outer periphery of said housing when they are closed against each other.

7. A protective cover according to claim 4, wherein said opening-and-closing members are provided with securing grooves at rear end portions thereof, and said wire guided from said housing is covered with a bellows-shaped tube engaged with said opening-and-closing members at said securing grooves.

8. A protective cover according to claim 4, wherein said first securing member is constituted by a securing hole formed on a connecting portion of at least one of said opening-and-closing members and a securing projection disposed on an outer surface of the rear end portion of said cover main body.

9. A protective cover according to claim 4, wherein said second securing member is constituted by a securing pawl formed on one of said opening-and-closing members and a securing frame formed on the other of said opening-and-closing members.

10. A protective cover according to claim 4, wherein said first securing member and said second securing member are respectively engaged substantially at the same time.

11. A protective cover according to claim 1, wherein said lock portion includes, recessed portions formed in one of said base portion and said cover portion; and securing projections formed on the other of said base portion and said cover, so that said recessed portions and said securing projections engage each other.

12. A protective cover according to claim 1, wherein said base portion is longer than said cover portion.

13. A protective cover according to claim 1, wherein side walls of said cover portion are fitted between an inner periphery of side walls of said bottom base portion.

* * * * *